US010100498B2

(12) United States Patent
Attwood et al.

(10) Patent No.: US 10,100,498 B2
(45) Date of Patent: Oct. 16, 2018

(54) LIP AND SHROUD ASSEMBLY

(71) Applicant: Bradken Resources Pty Limited, Mayfield West, NSW (AU)

(72) Inventors: Reece Attwood, Mayfield West (AU); Joel Nelio Martinelli, Merewether (AU)

(73) Assignee: Bradken Resources Pty Limited, Mayfield West, NSW (AU)

( * ) Notice: Subject to any disclaimer, the term of this patent is extended or adjusted under 35 U.S.C. 154(b) by 0 days.

(21) Appl. No.: 15/176,992

(22) Filed: Jun. 8, 2016

(65) Prior Publication Data

US 2016/0362875 A1 Dec. 15, 2016

(30) Foreign Application Priority Data

Jun. 11, 2015 (AU) ..... 2015902351

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01)

(58) Field of Classification Search
CPC ..... E02F 9/28; E02F 9/2883
USPC ..... 37/446, 451
See application file for complete search history.

(56) References Cited

U.S. PATENT DOCUMENTS 6,457,269 B1 * 10/2002 Esterhuyse ..... E02F 9/285 172/713
9,091,042 B2 * 7/2015 Guimaraes ..... E02F 9/2833
2007/0044349 A1 * 3/2007 McClanahan ..... E02F 9/28 37/452
2007/0051022 A1 * 3/2007 Meyers ..... E02F 9/2825 37/455
2013/0008062 A1 * 1/2013 Guimaraes ..... E02F 9/2833 37/446
2014/0230293 A1 * 8/2014 Lunn ..... E02F 3/40 37/444
2016/0369481 A1 * 12/2016 Hooijmans ..... E02F 3/60

FOREIGN PATENT DOCUMENTS

WO WO-2015/089565 6/2015

* cited by examiner

*Primary Examiner* — Matthew D. Troutman
(74) *Attorney, Agent, or Firm* — Morrison & Foerster LLP

(57) ABSTRACT

A lip for an excavation bucket, the lip comprising: an upper and a lower surface that extend to a digging edge; and a plurality of mounting sections for mounting shrouds to the lip to protect the digging edge against wear, at least one of the mounting sections comprising first and second bearing surfaces on one of the upper or lower surfaces of the lip and configured to have a shroud bear against when mounted to the mounting section, wherein the first and second bearing surfaces are inclined with respect to one another.

11 Claims, 8 Drawing Sheets

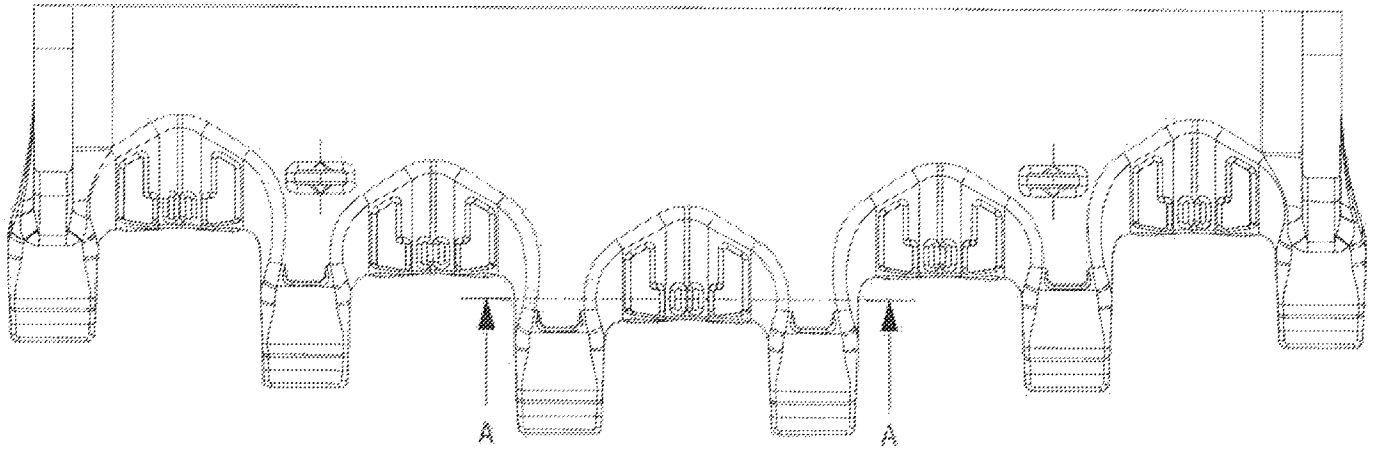
Figure 3
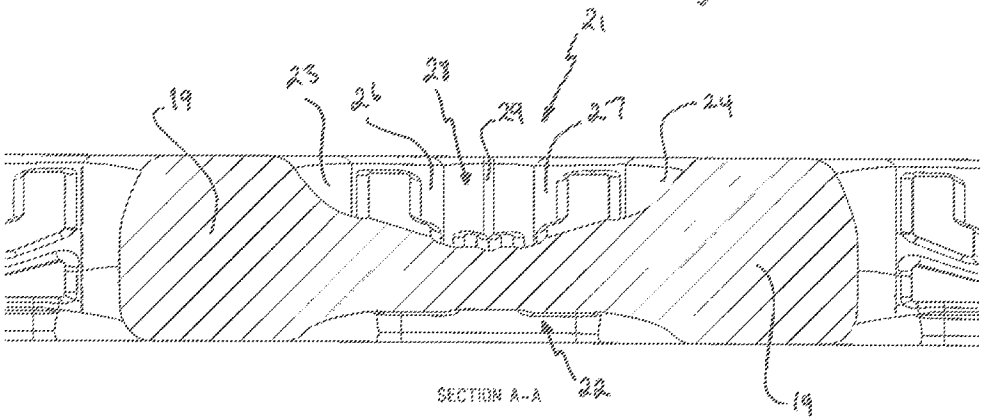

SECTION B-B

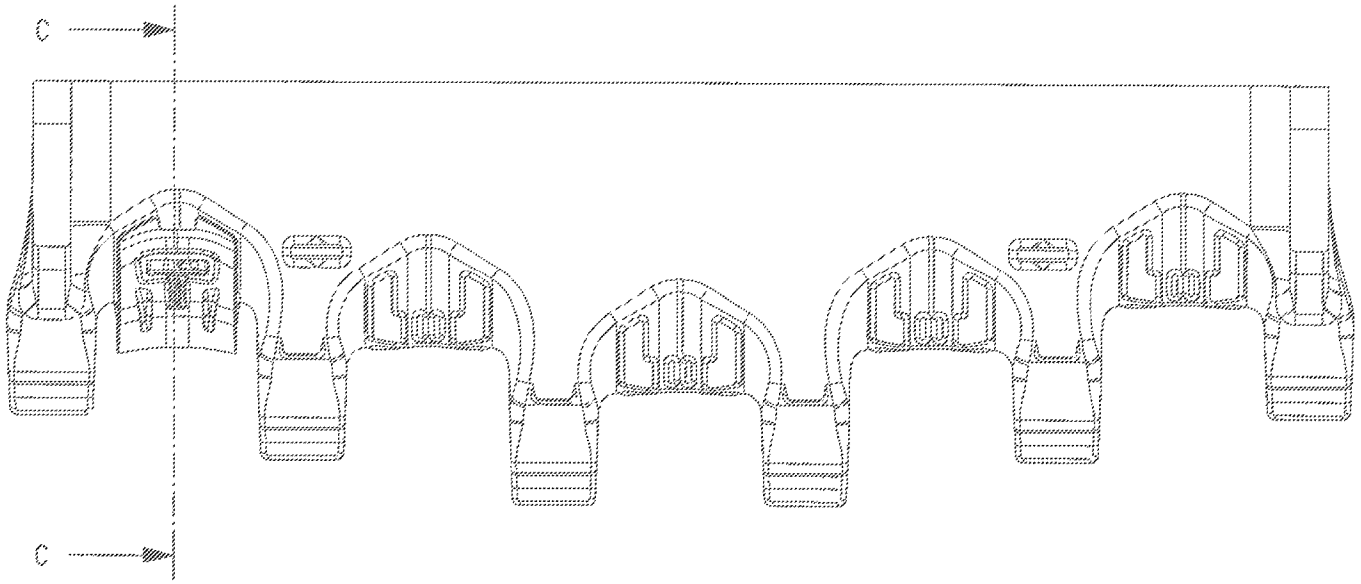
Figure 7
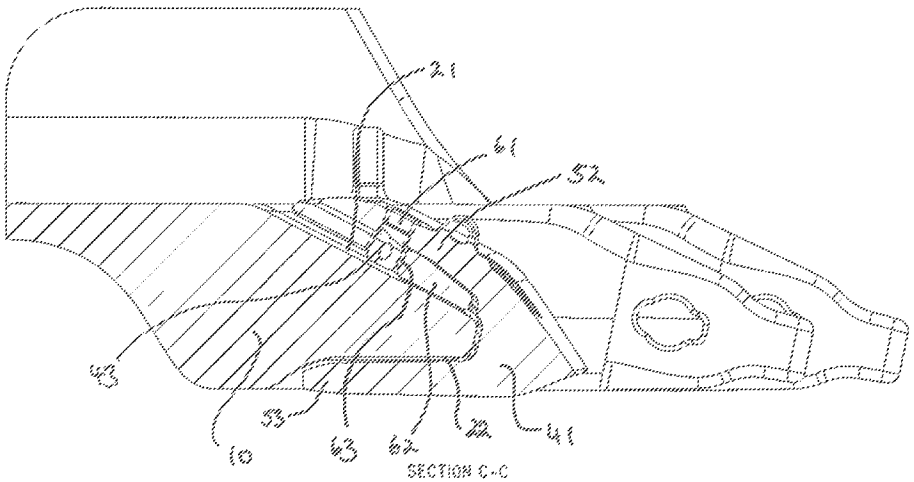

LIP AND SHROUD ASSEMBLY

CROSS-REFERENCE TO RELATED APPLICATION

This application claims priority from Australian Patent Application No. 2015902351, filed Jun. 11, 2015, the entire contents of which is incorporated herein by reference.

FIELD OF THE INVENTION

The present disclosure relates to a lip for an excavation bucket. The present disclosure also relates to shroud assemblies for attachment to excavation bucket lips.

BACKGROUND OF THE INVENTION

Excavating buckets are used in various digging and excavation operations and typically experience large forces during digging and excavation operations. Large excavating buckets are usually formed as a number of parts which are joined (typically by welding) to form the bucket. One of those components is a lip, which defines an edge portion of the bucket that engages the ground during digging operations.

Excavation teeth may be provided on the lip of the excavation bucket. Each excavation tooth is formed of a number of parts, commonly a point and a lock. The point is typically fitted over a nose that is integrally formed with and projects forwardly from a digging edge of the lip. The point is retained in place over the nose by the lock. In some instances one or more intermediate parts may be also included between the point and the nose.

On some excavation buckets, shrouds are also attached to the lip to protect the digging edge of the lip from wear. Where the lip has noses for mounting excavation teeth to the lip, shrouds are disposed along the lip between adjacent noses. Once worn, the shrouds can be removed and discarded and a replacement shroud attached. This reduces the need to replace the lip and/or the entire bucket due to wearing of the lip, which is more costly than replacing just the shrouds. The shrouds are attached to the lip by an assembly comprising the shroud itself, a base member that is attached to the lip and a mechanical locking device for locking the wear member to the base member and thus to lip, but which also allows the shroud to be removed once worn.

SUMMARY OF THE INVENTION

The present disclosure relates to improvements in lips for excavation buckets and to shrouds and shroud assemblies that are attached to the lips.

According to an embodiment of the present disclosure, there is provided a lip for an excavation bucket, the lip comprising: an upper and a lower surface that extend to a digging edge; and a plurality of mounting sections for mounting shrouds to the lip to protect the digging edge against wear, at least one of the mounting sections extending between first and second sides that are disposed along the digging edge and comprising a first surface portion that extends from the first side to a central region of the mounting section and a second surface portion that extends from the second side to the central region of the mounting section, wherein the first and second surface portions are inclined inwardly towards the central region with respect to one another and the width of the central region is less than a third of the width of the mounting section.

According to another embodiment of the present disclosure, there is provided a lip for an excavation bucket, the lip comprising: an upper and a lower surface that extend to a digging edge; and a plurality of mounting sections for mounting shrouds to the lip to protect the digging edge against wear, at least one of the mounting sections comprising first and second bearing surfaces on one of the upper or lower surfaces of the lip and configured to have a shroud bear against when mounted to the mounting section, wherein the first and second bearing surfaces are inclined with respect to one another.

According to another embodiment of the present, disclosure there is provided a lip for an excavation bucket, the lip comprising: an upper and a lower surface that extend to a digging edge; and a plurality of mounting sections for mounting shrouds to the lip to protect the digging edge against wear, at least one of the mounting sections having a central region and first and second side regions to either side of the central region, the central region of the mounting section defining a thinner portion of the lip than the first and second side regions and the width of the central region is less than a third of the width of the mounting section.

According to an embodiment of the present disclosure, there is provided a shroud for attachment to a lip of an excavation bucket, the shroud comprising: a body that extends forwardly to a ground engaging end; first and second spaced apart legs extending rearwardly from the body along respective longitudinal axis and configured to be received over upper and lower surfaces of the lip respectively, the first leg having a mounting surface for engaging a mounting section of the lip, the mounting surface comprising a first surface portion that extends from a first side to a central region of the first leg and a second surface portion that extends from a second side to the central region of the first leg, wherein the first and second surface portions are inclined with respect to one another; and a lock engaging portion for engagement by a lock to lock the shroud to the lip.

According to an embodiment of the present disclosure, there is provided a lock for locking a shroud to a lip of an excavation bucket, the lock comprising first and second bodies configured to be assembled together and movable with respect to each other between a locking configuration and a releasing configuration, wherein in their locking configuration the first and second bodies define a base extending between first and second ends of the lock, the base comprising a first surface portion that extends from the first end to a central region of the base and a second surface portion that from the second end to the central region of the base, wherein the first and second surface portions are inclined with respect to one another.

BRIEF DESCRIPTION OF THE DRAWINGS

Embodiments of the disclosure will now be provided, by way of example only, with reference to:

FIG. 3 is a partial cross-sectional view through A-A of the lip of FIG. 1 and in particular of a mounting section for a shroud;

FIG. 7 is a cross-sectional view through C-C of the shroud assembly of FIG. 6 assembled to the lip.

DETAILED DESCRIPTION OF THE INVENTION

Figure 1:
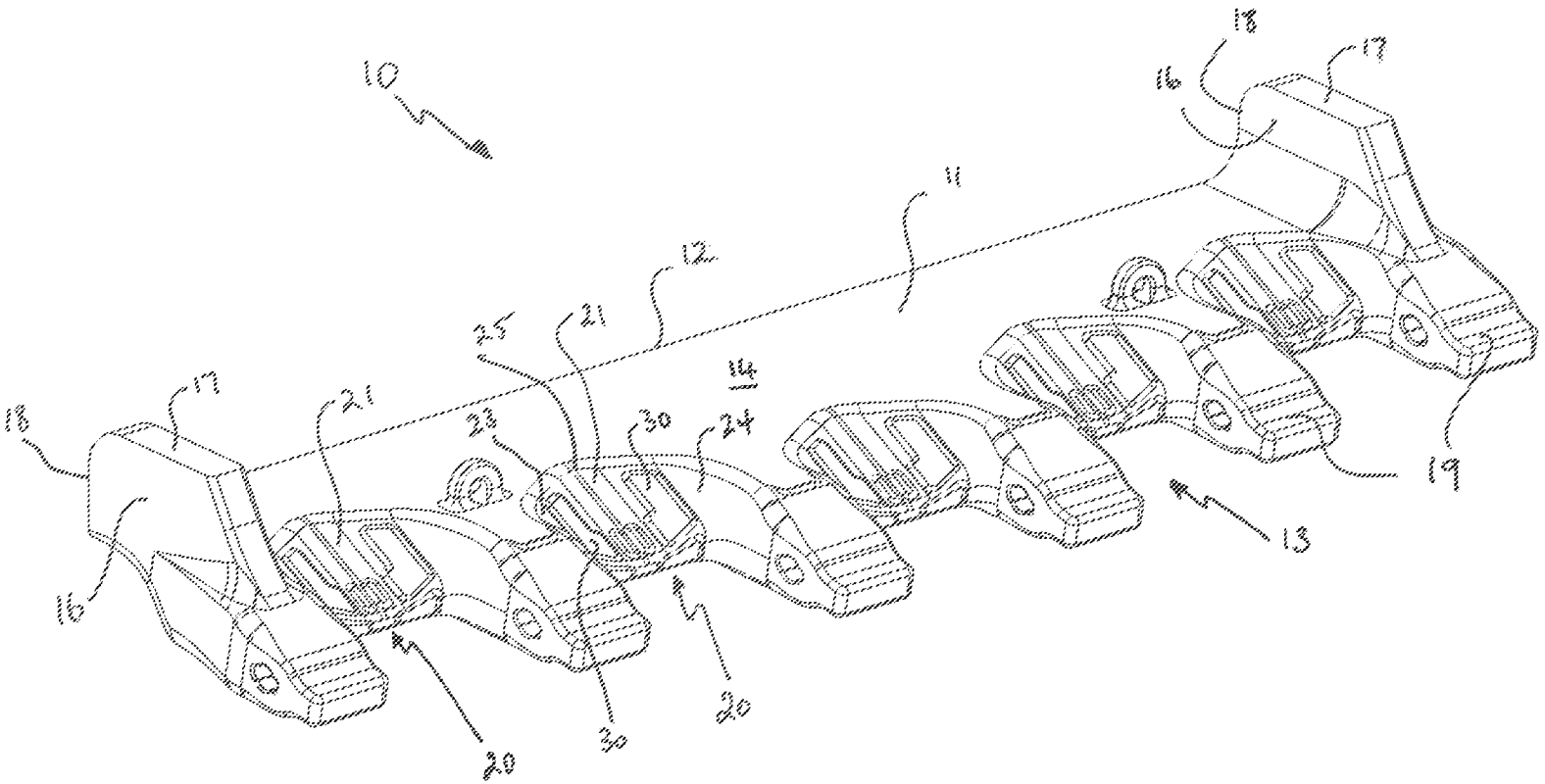
FIG. 1 is a perspective view of a lip for an excavation bucket according to an embodiment of the present disclosure.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure relates generally to lips for excavation buckets and to shrouds and shroud assemblies that are attached to the lips.

Disclosed in some embodiments is a lip for an excavation bucket, the lip comprising:

an upper and a lower surface that extend to a digging edge; and a plurality of mounting sections for mounting shrouds to the lip to protect the digging edge against wear, at least one of the mounting sections extending between first and second sides that are disposed along the digging edge and comprising a first surface portion that extends from the first side to a central region of the mounting section and a second surface portion that extends from the second side to the central region of the mounting section, wherein the first and second surface portions are inclined inwardly towards the central region with respect to one another and the width of the central region is less than a third of the width of the mounting section.

Disclosed in some embodiments is a lip for an excavation bucket, the lip comprising:

an upper and a lower surface that extend to a digging edge; and a plurality of mounting sections for mounting shrouds to the lip to protect the digging edge against wear, at least one of the mounting sections comprising first and second bearing surfaces on one of the upper or lower surfaces of the lip and configured to have a shroud bear against when mounted to the mounting section, wherein the first and second bearing surfaces are inclined with respect to one another.

Disclosed in some embodiments is a lip for an excavation bucket, the lip comprising:

an upper and a lower surface that extend to a digging edge; and a plurality of mounting sections for mounting shrouds to the lip to protect the digging edge against wear, at least one of the mounting sections having a central region and first and second side regions to either side of the central region, the central region of the mounting section defining a thinner portion of the lip than the first and second side regions and the width of the central region is less than a third of the width of the mounting section.

In an embodiment, the mounting section is formed in the upper surface.

In an embodiment, the mounting section is substantially V-shaped in cross-section through the lip parallel to the digging edge.

In an embodiment, the mounting section is concave in cross-section through the lip parallel to the digging edge.

In an embodiment, the upper and lower surfaces of the lip in said at least one mounting section incline towards each other as they extend to the digging edge In an embodiment, the first and second surface portions meet at an apex located in the central region of the mounting section.

In an embodiment, the first and second surface portions are substantially planar.

In an embodiment, the first and second surface portions are inclined at 145-155° relative to each other.

In an embodiment, said mounting section has a central region, first and second side surfaces disposed to either side of the central region and wherein the central region is configured to have a base attached thereto over which a shroud is mounted.

In an embodiment, the central region is configured to have a base attached thereto over which a shroud is mounted.

Disclosed in some embodiments is a shroud for attachment to a lip of an excavation bucket, the shroud comprising:

a body that extends forwardly to a ground engaging end;

first and second spaced apart legs extending rearwardly from the body along respective longitudinal axis and configured to be received over upper and lower surfaces of the lip respectively, the first leg having a mounting surface for engaging a mounting section of the lip, the mounting surface comprising a first surface portion that extends from a first side to a central region of the first leg and a second surface portion that extends from a second side to the central region of the first leg, wherein the first and second surface portions are inclined with respect to one another; and a lock engaging portion for engagement by a lock to lock the shroud to the lip.

In an embodiment, the mounting surface is V-shaped in cross-section through the first leg.

In an embodiment, the mounting surface is convex in cross-section through the first leg.

In an embodiment, the first and second surface portions of the mounting surface meet at an apex located in the central region of the mounting first leg.

In an embodiment, the lock engaging portion comprises an aperture through the first leg.

In an embodiment, the first and second surface portions are bearing surfaces for bearing against the mounting section of the lip.

In an embodiment, the first and second surface portions are substantially planar.

Disclosed in some embodiments is a lock for locking a shroud to a lip of an excavation bucket, the lock comprising first and second bodies configured to be assembled together and movable with respect to each other between a locking configuration and a releasing configuration, wherein in their locking configuration the first and second bodies define a base extending between first and second ends of the lock, the base comprising a first surface portion that extends from the first end to a central region of the base and a second surface portion that from the second end to the central region of the base, wherein the first and second surface portions are inclined with respect to one another.

In an embodiment, the first and second bodies each comprising at least one interengaging formation, the, or respective ones of the, interengaging formations on the bodies being configured to interengage when the bodies are in the assembled condition to form one or more couplings that resist lateral displacement of the bodies with respect to each other under loads applied transverse to the longitudinal axis of the assembled lock to the side of the first and second bodies.

In an embodiment, adjustment of the lock from the releasing to the locking configuration comprises the first body moving with respect to the second body to extend the lock in the direction of the lock's longitudinal axis and retract the lock in a direction transverse to the lock's longitudinal axis.

Disclosed in some embodiments is a shroud assembly for attachment to a lip of an excavation bucket, the shroud assembly comprising:

- a shroud as described in any one of the above embodiments; and
- a lock that is configured to engage the lock engaging portion of the shroud to hold the shroud to the lip in an assembled condition.

The lock of the shroud assembly may be a lock according to any one of the above described embodiments.

In an embodiment, the shroud assembly also comprising at least one base member configured to be attached to the lip and engaged by the lock to hold the shroud to the lip in the assembled condition.

Disclosed in some embodiments is a shroud assembly for attachment to a lip of an excavation bucket, the shroud assembly comprising:

- a base member having a mounting surface configured to engage the lip, the mounting surface comprising a first surface portion that extends from a first side to a central region of the base member and a second surface portion that extends from a second side to the central region of the base member, wherein the first and second surface portions are inclined with respect to one another;
- a shroud comprising a body that extends forwardly to a ground engaging end; and
- first and second spaced apart legs extending rearwardly from the body along respective longitudinal axis, one of the legs configured to be received over the base member in an assembled condition; and
- a lock configured to engage the base member and the shroud to hold the shroud to the lip in the assembled condition.

Figure 2:
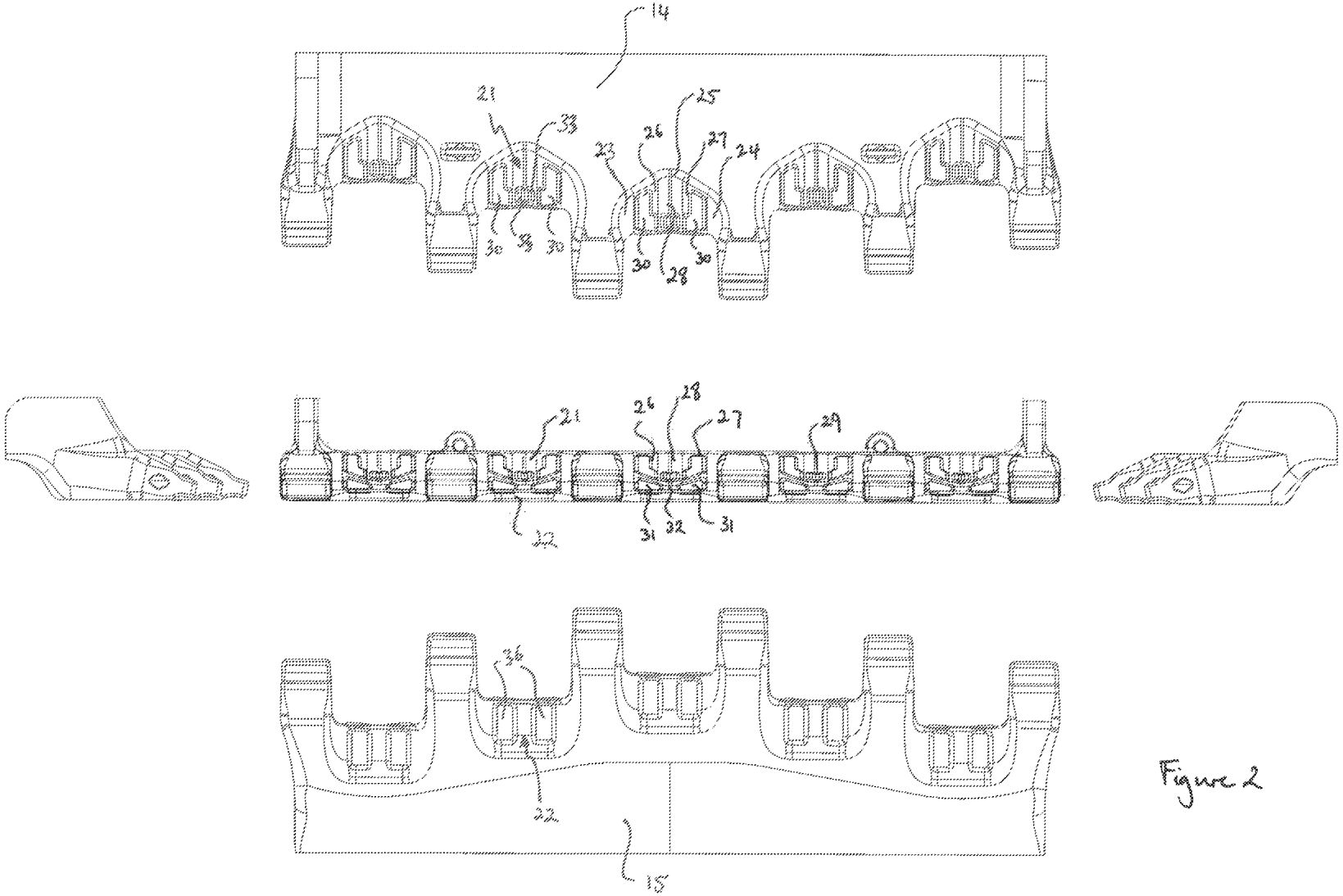
FIG. 2 is top, left side, front, right side and bottom views of the lip of FIG. 1.
Figure 4:
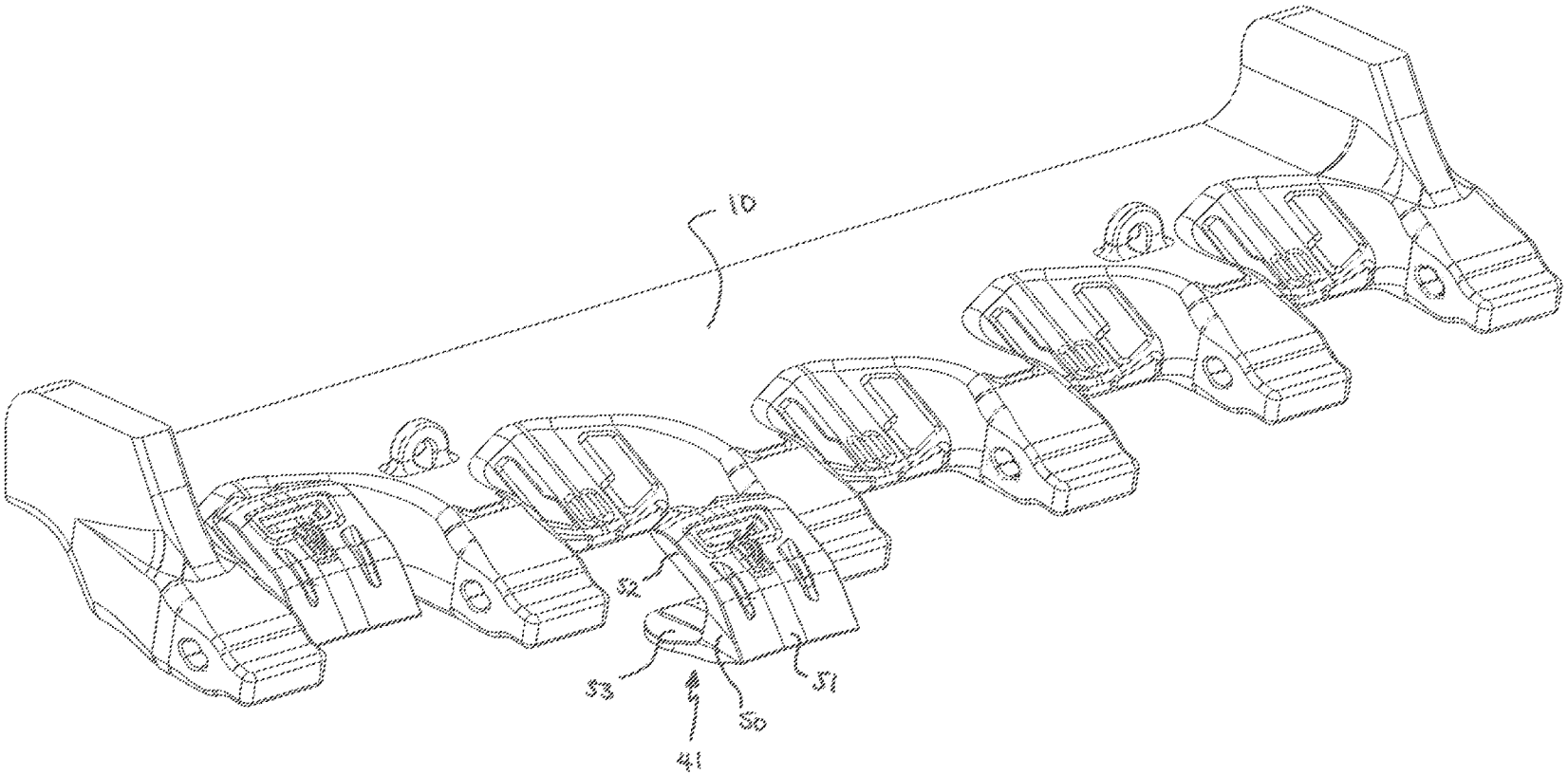
FIG. 4 is a perspective view of the lip of FIG. 1 with shrouds for protecting the digging edge of the lip shown attached and detached from the lip.
Figure 5:
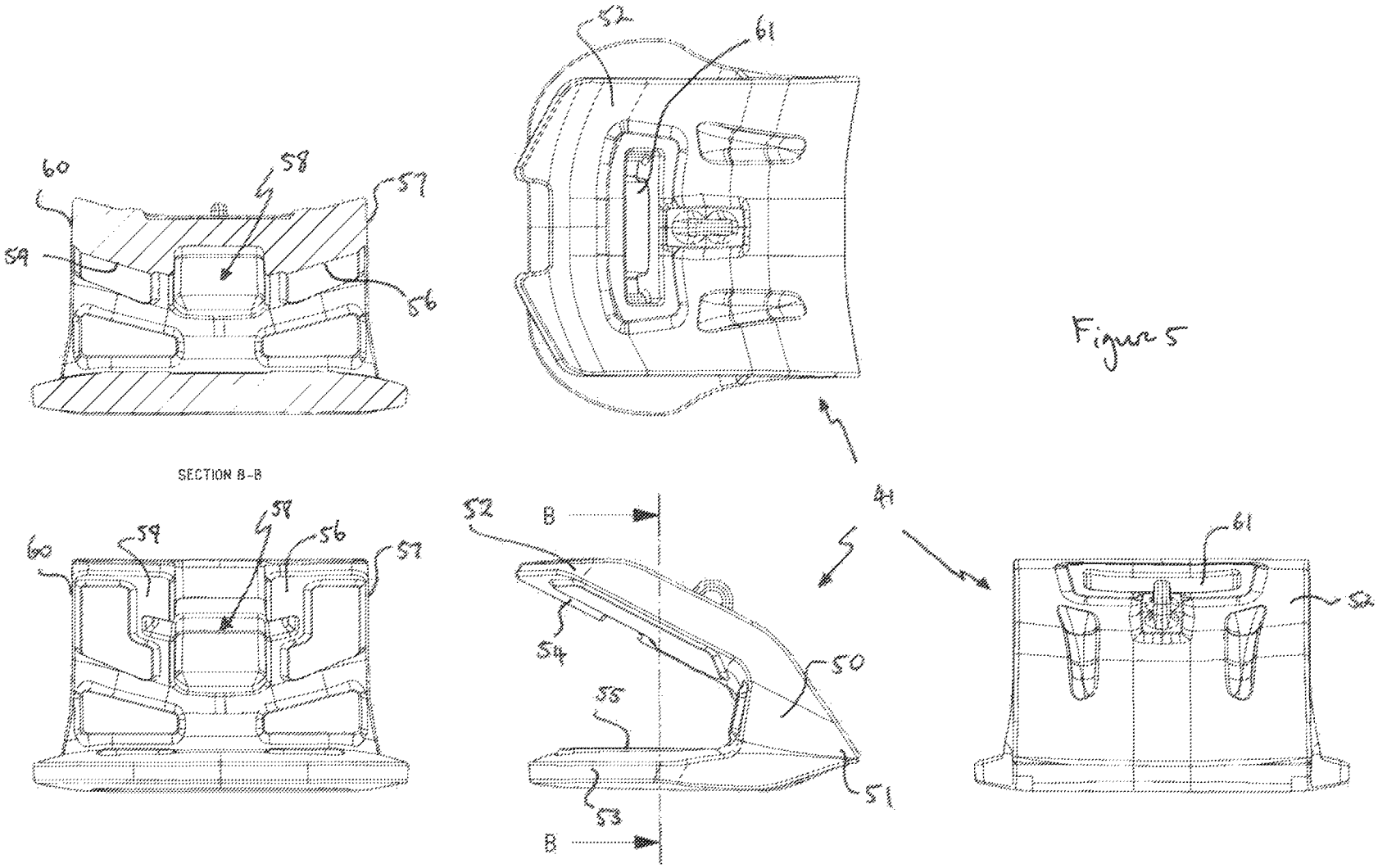
FIG. 5 is a top, front, side, rear and cross-sectional view through B-B of the shroud of FIG. 4.
Figure 6:
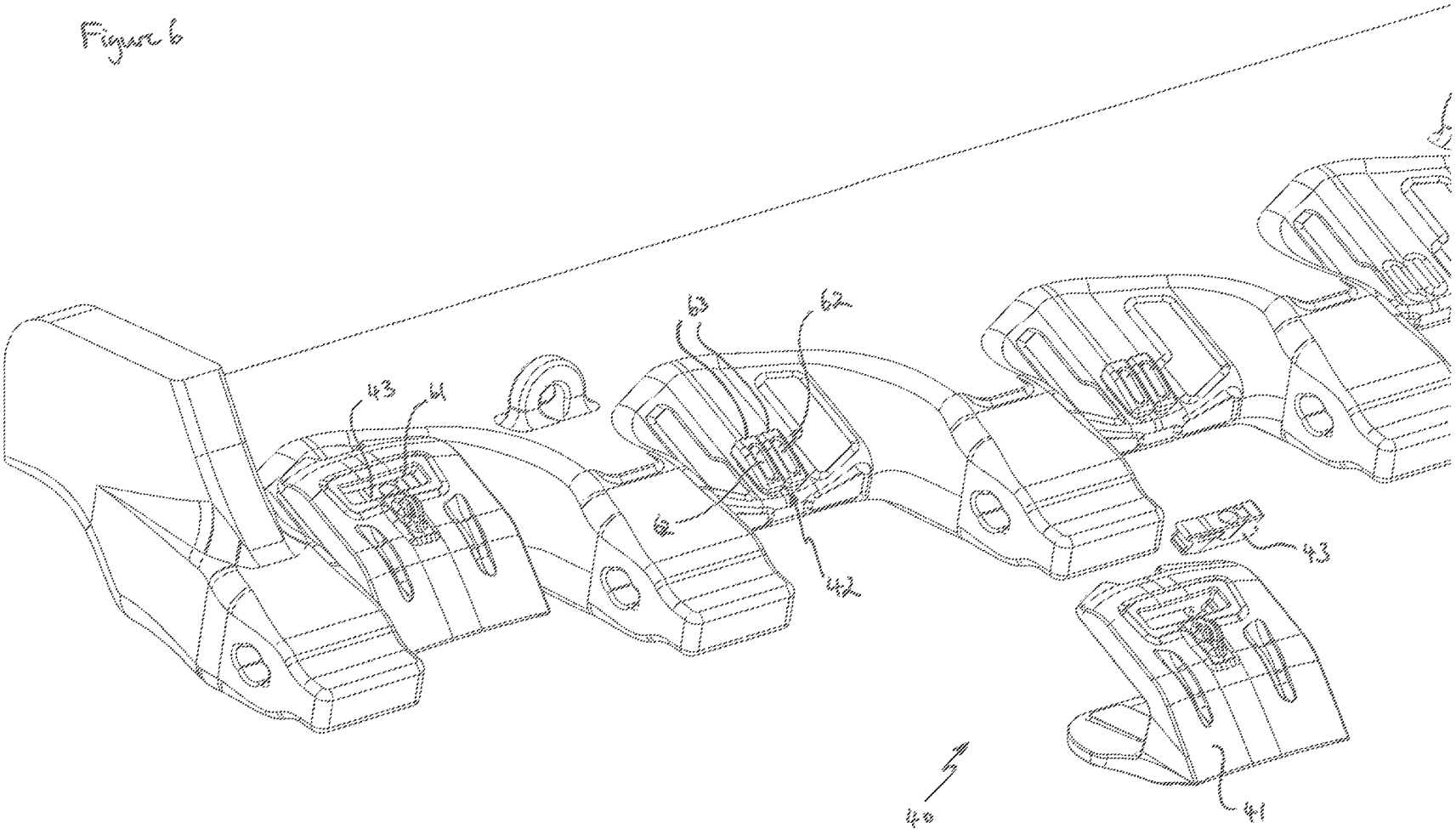
FIG. 6 is a perspective view of the lip of FIG. 1 with shroud assemblies each comprising the shroud of FIG. 5, a lock and base members shown in various stages of assembly with respect to the lip.
Figure 8:
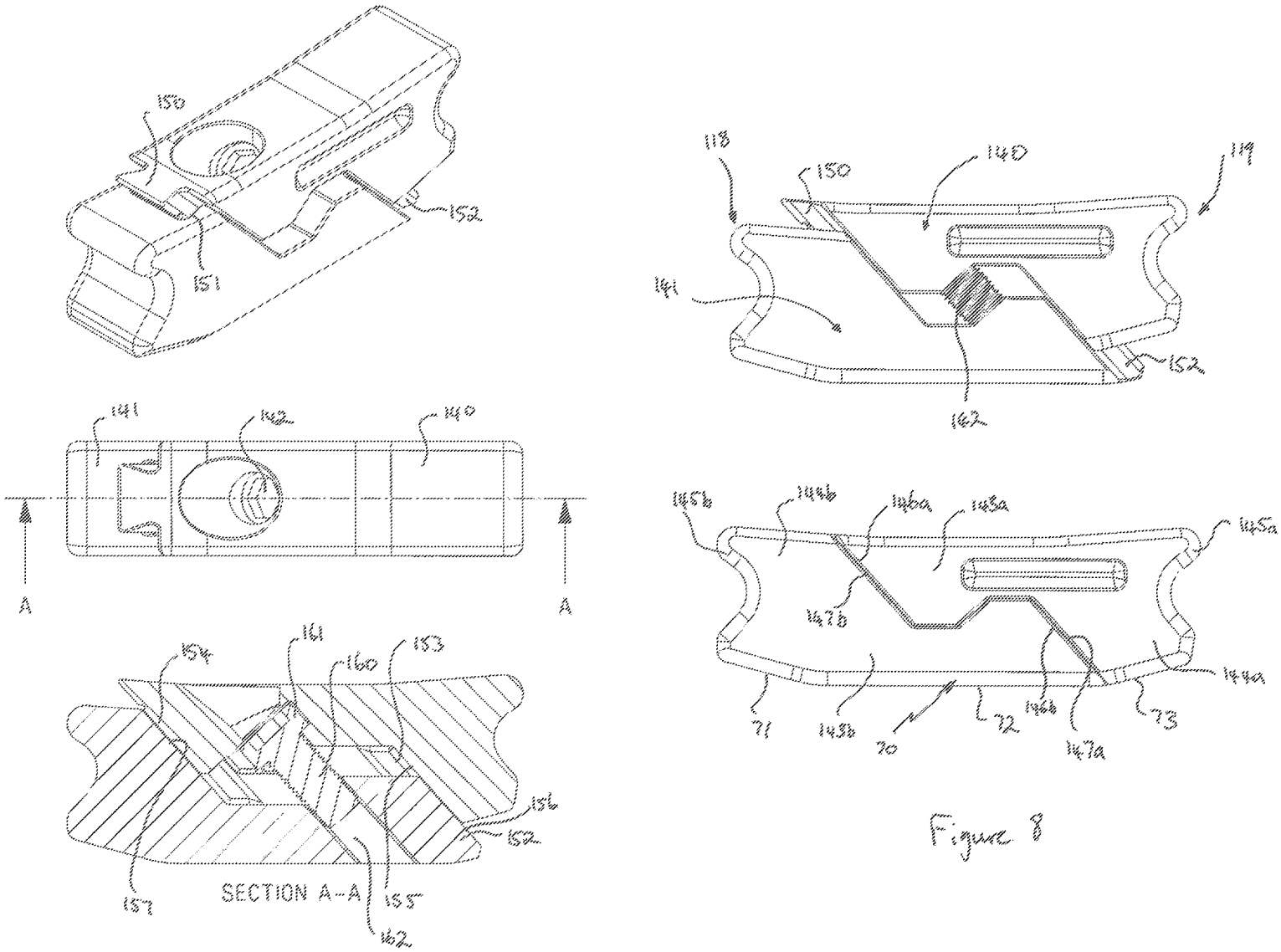
FIG. 8 is a perspective, side, top and cross-sectional view of the lock of FIG. 6.

Referring to FIGS. 1-3, there is shown a lip 10 for an excavation bucket according to an embodiment of the present disclosure. The lip 10 is shown in isolation from the rest of excavation bucket. The lip 10 is formed as a separate component from the other component(s) of the bucket and is attached to the bucket by welding. The lip 10 comprises a body or beam 11 that extends from a rear edge 12 to a digging edge 13. The rear edge 12, in use, is welded to the bucket. The body 11 of the lip has upper and lower surfaces 14, 15. The upper surface 14 forms part of the internal surface of the excavation bucket and the inner surface forms part of the excavation bucket's external surface. At opposed ends of the body 11 are upwardly extending wing portions 16, the top and rear surfaces 17, 18 of which are also welded to the bucket in use. Projecting forwardly from the digging edge 13 is a plurality of noses 19. The noses 19 are each configured to an excavation tooth mounted thereon. Although the lip is shown having six noses, it is to be appreciated that the lip could have any suitable number of noses. The number of noses (and hence the number of teeth that are attached to the lip) is generally dependent on the size of the lip.

Also disposed along the digging edge 13 of the lip 10 are a plurality of mounting sections 20 to which respective shrouds can be mounted to protect the digging edge against wear. Each of the mounting sections 20 are disposed between adjacent noses 19. In the illustrated embodiment, each of the mounting sections are substantially identical.

For convenience, the following description is provided in respect of a single mounting section. However, it is to be appreciated that because in the illustrated embodiment, all the mounting sections are substantially identical the describe features of the mounting section applies to all of the mounting sections. It is to also be appreciated that in other non-illustrated embodiments at least some mounting sections to which shrouds can be mounted may have different and/or additional features. In further embodiments, the lip may have no noses for attaching digging teeth and instead have only mounting sections for mounting shrouds to the lip.

The mounting section 20 extends rearwardly from the digging edge 13 of the lip. The mounting section 20 comprises first and second parts 21, 22 formed respectively in the upper and lower surfaces 14, 15 of the lip 10. The first parts 21 formed in the upper surface 14 extends between a first side edge and a second side 23, 24 and from the digging edge 13 to a rear edge 25. The sides 23, 24 of the first mounting section part 21 are disposed along the digging edge 13 and extend at least in part rearwardly of respective noses 19. The sides 23, 24 of the first part 21 are concavely curved about an axis perpendicular through the upper and lower surfaces of the lip. As a result the maximum width of the mounting section 20 is greater than the distance between the noses 19 to either side of the mounting section. The rear edge 25 of the first depression 21 is also concavely curved about an axis perpendicular through the upper and lower surfaces of the lip. The curved rear edge 25 and curved sides 23, 24 reduce the buildup of stresses in the lip during use.

The mounting section 20 comprises first and second surface portions 26, 27 in the upper surface of the lip. The first surface portion 26 extends from the first side 23 to a central region 28 of the mounting section and the second surface portion 27 extends from the second side 24 to the central region 28 of the mounting section. The first and second surface portions 26, 27 are inclined inwardly towards the central region 28 with respect to one another (see FIG. 3 in particular). The central region is narrow; having a width that is less than a third of the width of the mounting section, preferably less than a fifth. The mounting section 20 is thus approximately V-shaped in cross-section through the lip parallel to the digging edge. Also, the shape of the mounting section results in the mounting section of the lip being thicker at the sides of the first depression and tapered towards its central region. That is, the mounting section defines a thinner portion of the lip in the central region relative to first and second side regions to either side of the central region.

The first and second surface portions may be substantially planar or may comprises two or more segments that are planar or curved or a mixture of planar and curved such that in some embodiments the mounting section is approximately concave in cross-section through the lip parallel to the digging edge. The first and second surface portions 26, 27 are connected at the central region 28 of the mounting section to form the apex 29 of the V-shaped depression. The angle between the first and surface portions 26, 27 where they connect at the central region is approximately 145-155°, preferably about 150°.

The first and second surface portions 26, 27 also taper (relative to the lower surface of the lip) from the rear edge 25 of the first part 21 of the mounting section 20 to the digging edge 13 of the lip. Thus, the shape of the mounting section is such that it is thicker at the rear of the mounting section and thinning towards the digging edge.

Advantageously, the shape of the mounting section allows the weight of the lip to be reduced whilst substantially retaining the strength of the lip. Typically, the mass of the lip is reduced by a minimum of 5% when compared to conventional lips. The mass reduction is achieved by both reducing the material at the location of the mounting sections as well as the thickness of the lip body 11. By reducing the mass of the lip the cost of manufacturing the lip is reduced. In addition, the efficiency of operating an excavation bucket with the lip attached is increased. At the same time, the lip's fatigue life is maintained. Accordingly the lip can be retained in service for the same amount of time.

The first and second surface portions 26, 27 act as the bearing surfaces for a shroud when mounted to the lip 10. As such the bearing surfaces on the lip for the shroud are inclined with respect to each other. Because the bearing surfaces are inclined, they can extend close to the center of the mounting section. As a result, the thinnest region of the mounting section (the central region) is very narrow and the mounting section retains additional thickness across the majority of its width. These thicker, tapering, lateral regions to either side of the central region enable the lip to maintain its strength, particularly in response to the predominantly torsional forces that the lip is subjected to during use.

The mounting section 20 also comprises an L-shaped mounting pad 30 incorporated into each of respective first and second surface portions 26, 27. The pads provide stabilizing surfaces for the shroud bearing on the first and second surface portions 26, 27. A second set of mounting pads 31 that are also abutted by the shroud when mounted to the lip are incorporated into the end face 32 of the digging edge 13. The second mounting pads 31 are substantially triangular in shape. The upper part 21 of the mounting section 20 also comprises a third set of mounting pads 33 in the central region 28 to which a base member of a shroud assembly is to be mounted.

As previously mentioned, the mounting section comprises a second part 22 formed in the lower surface 15 of the lip. The second part 22 of the mounting section 20 extends rearwardly from the digging edge 13 of the lip 10 and is opposed to the first part 21 of the mounting section. The majority of lip surface defined by the second part of the mounting section is substantially parallel to the lower surface 15 of the lip 10. A fourth set of mounting pads 36 for abutment by the shroud when mounted to the lip are incorporated into the lip surface defined by the second part of the mounting section. Because the first and second surface portions 26, 27 of the upper part 21 of the mounting section 20 are tapered towards the digging edge 13 and the lip surface defined by the lower part 22 of the mounting is substantially parallel to the lower surface of the lip, the lip at its digging edge 13 is below the center of the lip body 11. Advantageously, this has been found to increase the efficiency of the excavation bucket during digging operations as a result of lowering the leading edge of the excavation bucket provided by the lip and the teeth and shrouds attached thereto relative to the lower or outer surface of the bucket.

Referring now to FIGS. 4-8, a shroud assembly 40 for use with the lip 10 described above is shown. The shroud assembly 40 comprises a shroud 41, a base 42 and a lock 43.

The shroud 41 comprises a body 50 that extends forwardly to a ground engaging end 51 and first and second spaced apart legs 52, 53 that extend rearwardly from the body 50. The first leg 52 is configured to engage the upper surface 14 of the lip 10 and the second leg 53 is configured to engage the lower surface 15 of the lip 10. More particularly, the first leg 52 is configured to be received in the first part 21 of one of the mounting sections 20 and the second leg 53 is configured to be received in the second part 22. Each of the first and second legs 52, 53 have mounting surfaces 54, 55 that are complementary to respective first and second parts 21, 22 of the mounting section 20.

The mounting surface 54 of the first leg 52 comprises a first surface portion 56 that extends from a first side 57 to a central region 58 of the first leg and a second surface 59 portion that extends from a second side 60 to the central region 58 of the first leg. The first and second surface portions 56, 59 are inclined with respect to one another. The mounting surface 54 of the first leg 52 is thus approximately V-shaped in cross-section. The first and second surface portions may be substantially planar or may comprises two or more segments that are planar or curved or a mixture of planar and curved such that in some embodiments the mounting surface of the first leg is approximately concave in cross-section. The inclined first and second surface portions 56, 59 of the shroud are configured to bear respectively on the first and second inclined surface portions 26, 27 of the mounting section 20 on the lip 10.

The shroud 41 also comprises an aperture 61 through the first leg 52 in which the lock 43 is received to lock the shroud to the lip. At least one internal surface of the aperture defines a lock engagement portion for engagement by the lock in an operative position to lock the shroud to the lip. The aperture 61 extends longitudinally, perpendicular to the longitudinal axis of the first leg.

The base 42 is formed by two substantially identical bosses 62. Although, in other embodiments, the base could be provided by a single member. The bosses 62 are welded to lip 10 to attach them thereto, specifically to a surface of the central region 28 of the mounting section 20. The bosses 62 and the shroud 41 are shaped so that when the shroud 41 is mounted to the lip 10, the first leg 52 of the shroud 41 fits over the bosses. Rear surfaces 63 of the bosses 62 provide a lock engagement portion that is engaged by the lock 43 when in its operative position to lock the shroud to the lip. When in this position, the lock 43 is sandwiched between the rear surfaces 63 of the bosses 62 and a forward facing internal surface of the aperture 61 of the shroud 41.

The lock 43 is similar to the lock described in the Applicant's earlier PCT patent application PCT/AU/2014/001149 which is incorporated herein by reference. The lock 43 is shown in detail in FIG. 8.

The lock 43 is elongate, extending along a longitudinal axis between first and second ends 118, 119. The lock 43 is formed from a lock assembly comprising first and second lock bodies 140, 141 and an adjustment member 142 operable to move the first and second bodies relative to each other.

The first and second bodies 140, 141 when assembled together define a base 70 extending between first and second ends of the lock. The base 70 comprises a first surface portion 71 that extends from the first end 118 to a central region 72 of the base and a second surface portion 73 that from the second end 119 to the central region 72 of the base. The first and second surface portions 71, 73 are inclined with respect to one another. This shaping of the base 70 of the lock enables the lock 43 to fit with the shaping of the mounting section 20 on the lip 10 when locking the shroud 41 to the lip.

Each of the bodies 140, 141 are generally L-shaped with an elongate portion 143*a,b* and a foot portion 144*a,b* extending transversely from the elongate portion. The foot portion 144*a,b* is located towards a first end 145*a,b* of the elongate portion 143*a,b*. The bodies 140, 141 are configured so that when they are in an assembled condition, their respective elongate portions are parallel to each other and their respective second ends 146*a,b* engage an inner surface 147*a,b* of the foot portion 144*a,b* of the other body. Thus, in the assembled condition, the bodies 140, 141 are vertically stacked with the elongate portion 143*a* of the first body 140 positioned above the elongate portion 143*b* of the second body 141. The parallel elongate portions 143*a,b* in the assembled condition define the longitudinal axis of the lock 43. In the assembled condition, the first end 145*b* of the second body 141 is located at the first end 118 of the lock 43 and the first end 145*a* of the first body 140 is located at the second end 119 of the lock. The base 70 of the lock 43 is formed by the elongate portion 143*b* of the second body 141 and the foot portion 144*a* of the first body 140.

The bodies 140, 141 comprise first and second respective interengaging formations that interengage when the bodies are in the assembled condition to form first and second respective couplings. The interengagng formations are in the form of tongue and groove formations. The first of the couplings comprises a tongue 150 at the second end 146*a* of the first body 140 that is configured to be received in a groove 151 formed in the inner surface 147*b* of the foot portion 144*b* of the second body 141. The second of the couplings comprises a tongue 152 at the second end 146*b* of the second body 141 and a groove 153 in the inner surface 147*a* of the foot portion 144*a* of the first body 140. The first and second couplings are arranged such that there is a coupling at each end of the lock and in upper and lower regions of the lock. The first and second couplings are spaced from each other by the elongate portions 143*a,b* of the bodies 140, 141.

The end face 154 of the tongue 150 on the first body 140 defines a surface that is parallel to the base surface 157 of the groove 153 of the first body 140, both of which are at a transverse angle (but not perpendicular) to the lock's longitudinal axis. Similarly, the end face 156 of the tongue 152 on the second body 141 defines a surface that is parallel to the base surface 155 of the groove 151 of the second body 141 both of which are also at the same transverse angle to the lock's longitudinal axis. This allows for the first body to slide over the second body easily along a translation axis defined by the surfaces 154-157, which is transverse to but not perpendicular to the lock's longitudinal axis, as discussed further below.

Each of the tongues 150, 152 widen as they extend away from their respective first and second bodies 140, 141. This means that the side surfaces of the respective tongues 150, 152 are angled toward each other in the direction toward their respective bodies 140, 141. Similarly, the grooves 151, 153 widen as they extend into their respective first and second bodies 140, 141 so as to accommodate the tongue of the other body. The side surfaces of the grooves are thus angled away from each other as they extend into their respective bodies. The tongues and grooves 150-153 thus have a dovetail profile.

When the lock 43 is located in the aperture 61 of the shroud 41, the lock is positioned such that its longitudinal axis is perpendicular to the longitudinal axis of the shroud. In use, because the lock is positioned to limit movement of the shroud 41 in the direction of the shroud's longitudinal axis, loads are applied on the lock transverse to the lock's longitudinal axis to the side of the lock. Because the lock 43 comprises first and second bodies 140, 141 that are assembled together in a vertical arrangement whereby the first body is positioned above the second body, the side transverse loads on the lock can result in lateral displacement of the lock bodies with respect to the other. The first and second tongue and groove couplings described above resist this lateral displacement of the bodies with respect to each other because the tongues 150, 152 bear against respective side surfaces of the grooves 151, 153 in which they are received. Lateral displacement is resisted by the tongue and groove arrangements because the lock bodies 140, 141 have surfaces which bear on each other that are laterally disposed on either side of the lock. Further, the tapered shape of the tongues and grooves 150-153 provide resistance to longitudinal displacement and reduce the risk of the lock 43 pulling apart under longitudinal forces.

The interengaging formations are arranged, however, to enable the first and second bodies to move by translation along the translation axis defined by the tongue end faces 154, 156 which mate with respective groove base surfaces 155, 157. That is, the tongues 150, 152 are capable of sliding within the grooves 151, 153. The adjustment member 142 is provided to operate this movement.

The adjustment member 142 comprises a threaded shank 160 extending from a head portion 161 and in the embodiment shown is in the form of a cap screw. The lock bodies 140, 141 define a cavity 162 in which the adjustment member 142 is received. The cavity 162 extends across the bodies 140, 141 and comprises a first cavity portion in the elongate portion 143*a* of the first body 140 and a second cavity portion in the elongate portion 143*b* of the second body 141. Each cavity portion opens through the top and bottom surfaces of the long portions 143*a,b* of their respective bodies 140, 141. The cavity portions 163, 164 are axially aligned when the bodies 140, 141 are in the assembled condition. The cavity 162 extends through the bodies 140, 141 transverse to the longitudinal axis of the lock 43 and substantially parallel to the tongue end faces 154, 156 and the groove base surfaces 155, 157.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Accordingly, the present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A lip for an excavation bucket, the lip comprising:

an upper and a lower surface that extend to a digging edge; and a plurality of mounting sections for mounting shrouds to the lip to protect the digging edge against wear, at least one of the mounting sections extending between first and second sides that are disposed along the digging edge and the at least one mounting section comprising a central region, a first surface portion that extends from the first side to the central region and a second surface portion that extends from the second side to the central region, the central region extends between the first surface portion and the second surface portion, and the first and second surface portions extend downwardly respectively from the first side and second side and are inclined relative to the central region and the first and second sides, wherein the width of the central region is less than a third of the width of the mounting section.

2. A lip for an excavation bucket according to claim 1, wherein the first surface portion and the second surface portion respectively comprise first and second bearing surfaces on one of the upper or lower surfaces of the lip and configured to have a shroud bear against when mounted to the mounting section.

3. A lip for an excavation bucket according to claim 1, wherein a first side region includes the first side and the first surface portion, and a second side region includes the second side and the second surface portion, and the central region of the mounting section defining a thinner portion of the lip than the portion of the lip defined by the first side region and the second side region.

4. The lip for an excavation bucket of claim 1, wherein the mounting section is formed in the upper surface.

5. The lip for an excavation bucket of claim 1, wherein the mounting section is substantially V-shaped in cross-section through the lip parallel to the digging edge.

6. The lip for an excavation bucket of claim 1, wherein the mounting section is concave in cross-section through the lip parallel to the digging edge.

7. The lip for an excavation bucket of claim 1, wherein the upper and lower surfaces of the lip in said at least one mounting section incline towards each other as they extend to the digging edge.

8. The lip for an excavation bucket of claim 1, wherein the first and second surface portions meet at an apex located in the central region of the mounting section.

9. The lip for an excavation bucket of claim 1, wherein the first and second surface portions are substantially planar.

10. The lip for an excavation bucket of claim 1, wherein the first and second surface portions are inclined at 145-155° relative to each other.

11. The lip for an excavation bucket of claim 1, wherein the central region is configured to have a base attached thereto over which a shroud is mounted.

* * * * *